US011594354B2

(12) United States Patent
Nakajima et al.

(10) Patent No.: US 11,594,354 B2
(45) Date of Patent: Feb. 28, 2023

(54) MAGNETIC BASE BODY CONTAINING SOFT MAGNETIC METAL PARTICLES AND ELECTRONIC COMPONENT INCLUDING THE SAME

(71) Applicant: TAIYO YUDEN CO., LTD., Tokyo (JP)

(72) Inventors: Takashi Nakajima, Tokyo (JP); Shunta Ishiwata, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 590 days.

(21) Appl. No.: 16/574,816

(22) Filed: Sep. 18, 2019

(65) Prior Publication Data

US 2020/0105447 A1 Apr. 2, 2020

(30) Foreign Application Priority Data

Sep. 27, 2018 (JP) ..... JP2018-181117

(51) Int. Cl.

| | |
|---|---|
| ***H01F 1/147*** | (2006.01) |
| ***H01F 27/255*** | (2006.01) |
| ***H01F 1/24*** | (2006.01) |
| ***C22C 38/06*** | (2006.01) |
| ***C22C 38/02*** | (2006.01) |

(52) U.S. Cl.

CPC ..... *H01F 1/14791* (2013.01); *H01F 1/14766* (2013.01); *H01F 1/24* (2013.01); *H01F 27/255* (2013.01); *C22C 38/02* (2013.01); *C22C 38/06* (2013.01); *Y10T 428/32* (2015.01)

(58) Field of Classification Search

None

See application file for complete search history.

(56) References Cited

U.S. PATENT DOCUMENTS

| | | | | |
|---|---|---|---|---|
| 5,389,482 | A * | 2/1995 | Okano | H01F 41/16 430/138 |
| 2020/0098505 | A1* | 3/2020 | Uchikawa | H01F 1/24 |
| 2020/0312513 | A1* | 10/2020 | Ishiwata | H01F 27/2852 |
| 2022/0208422 | A1* | 6/2022 | Tanada | H01F 27/255 |

(Continued)

FOREIGN PATENT DOCUMENTS

| | | | |
|---|---|---|---|
| JP | 2010-034102 | A | 2/2010 |
| JP | 2013-168648 | A | 8/2013 |
| JP | 2013168648 | A * | 8/2013 |

OTHER PUBLICATIONS

Machine Translation of JP 2013-168648 A (Year: 2013).*

(Continued)

*Primary Examiner* — Kevin M Bernatz

(74) *Attorney, Agent, or Firm* — Pillsbury Winthrop Shaw Pittman, LLP

(57) ABSTRACT

A magnetic base body according to one embodiment of the invention includes soft magnetic metal particles that have an insulating film on their surfaces. In a Raman spectrum obtained by observing light scattered when the magnetic base body is irradiated with an excitation laser with a wavelength of 488 nm, a peak intensity ratio. that is defined as a ratio of the peak intensity of a first peak existing at around a wave number of 712 $cm^{-1}$ to the peak intensity of a peak existing at around a wave number of 1320 $cm^{-1}$, is 1 to 70.

15 Claims, 3 Drawing Sheets

(56) References Cited

U.S. PATENT DOCUMENTS

2022/0293316 A1* 9/2022 Misawa ..... H01F 1/14766

OTHER PUBLICATIONS

Notice of Reasons for Refusal dated Feb. 8, 2022, issued in corresponding Japanese Patent Application No. 2018-181117 with English translation (9 pgs.).
Decision of Refusal dated Aug. 23, 2022, issued in corresponding Japanese Patent Application No. 2018-181117, with English translation (9 pgs.).

* cited by examiner

MAGNETIC BASE BODY CONTAINING SOFT MAGNETIC METAL PARTICLES AND ELECTRONIC COMPONENT INCLUDING THE SAME

CROSS-REFERENCE TO RELATED APPLICATIONS

This application is based on and claims the benefit of priority from Japanese Patent Application Serial No. 2018-181117 (filed on Sep. 27, 2018), the contents of which are hereby incorporated by reference in its entirety.

TECHNICAL FIELD

The present invention relates to a magnetic base body containing soft magnetic metal particles and an electronic component including the magnetic base body.

BACKGROUND

Various magnetic materials have been used as a material for a magnetic base body used in electronic components. Ferrite is often used as a magnetic material for coils such as inductors. Ferrite is suitable as the magnetic material for an inductor because of its high magnetic permeability.

In addition to ferrite, a soft magnetic metal material is also used as the magnetic material for the magnetic base body. A soft magnetic metal material is contained in the magnetic base body in the form of soft magnetic metal particles (or powder). The magnetic base body containing the soft magnetic metal particles is produced through a pressure molding process in which a slurry is made by mixing and kneading the soft magnetic metal particles and a binder, the slurry is poured into a mold, and pressure is then applied to the slurry in the mold. An insulating film is provided on the surface of each soft magnetic metal particle contained in the magnetic base body so as to prevent a short circuit between adjacent particles. Since the soft magnetic metal material generally has a higher saturation magnetic flux densities than the ferrite material, it is suitable as a material for the magnetic base body of a coil element through which a large current flows.

Magnetic base bodies for electronic components such as inductors are required to have a high magnetic permeability. There have been proposals of techniques for increasing the filling factor of the magnetic particles in the magnetic base body to increase the magnetic permeability. For example, Japanese Patent Application Publication 2010-34102 ("the '102 Publication") discloses a clay-like magnetic base body in which two or more kinds of amorphous soft magnetic metal particles having different average particle sizes and an insulating binder are mixed. The '102 Publication describes that it is possible to realize a high filling factor and a low core loss with such a magnetic base body.

By increasing a compacting pressure at the time of molding the magnetic base body, the filling rate of the soft magnetic metal particles can be increased. However, when the compacting pressure is increased, the insulating film provided on the surfaces of the soft magnetic metal particles tend to be broken, which deteriorates the insulation property between the soft magnetic metal particles.

Since the insulating film provided on the surfaces of the soft magnetic metal particles generally has a lower magnetic permeability than that of the soft magnetic metal, the content ratio of the soft magnetic metal in the magnetic base body can be increased by thinning the insulating film in order to increase the magnetic permeability of the magnetic base body. There is such an idea to improve the magnetic permeability of the magnetic base body. However, when the insulating film is thinned, there is a drawback that the insulation between the soft magnetic metal particles is decreased.

When dielectric breakdown occurs between soft magnetic metal particles, adjacent soft magnetic metal particles merge into a single large particle. Eddy currents are likely to be generated in the large particles. Thus there is a drawback that the eddy current loss increases when dielectric breakdown occurs between adjacent soft magnetic metal particles contained in the magnetic base body.

As described above, it is desired to achieve both the high magnetic permeability and the high insulation property of the magnetic base body containing the soft magnetic metal particles. However, since the magnetic permeability of the insulating base and the insulation property between the soft magnetic metal particles are in a trade-off relationship, it is difficult to achieve both the high permeability and high insulation property.

SUMMARY

An object of the present invention is to solve or relieve at least a part of the above problem. More specifically, one object of the invention is to provide a magnetic base body in which both the high magnetic permeability and the high insulation property are achieved. Other objects of the present invention will be made apparent through description in the entire specification.

According to one aspect of the invention, provided is a magnetic base body containing soft magnetic metal particles having an insulating film on their surfaces. In a Raman spectrum obtained by using an excitation laser with a wavelength of 488 nm, a peak intensity ratio is 1 to 70. The peak intensity ratio is defined as a ratio of a peak intensity of a first peak existing at around a wave number of 712 $cm^{-1}$ to a peak intensity of a peak existing at around a wave number of 1320 $cm^{-1}$.

In the magnetic base body, the peak intensity ratio may be 1.5 to 5.8.

In the magnetic base body, the peak intensity ratio may be 1.5 to 2.0.

In a cross-sectional photograph of the magnetic base body taken with a scanning electron microscope, a ratio of an area of the insulating film to an area of the soft magnetic metal particles may be 2% or more.

In the magnetic base body, the soft magnetic metal particles may be made of an iron-containing alloy.

Another aspect of the invention relates to an electronic component. The electronic component includes the above-described magnetic base body.

The electronic component may include the magnetic base body and a coil embedded in the magnetic base body. The coil may be embedded in the magnetic base body. Alternatively, the coil may be disposed in the magnetic base body such that at least a part of the coil is exposed to the outside of the magnetic base body.

According to the aspects of the invention, it is possible to obtain a magnetic base body having a high magnetic permeability and a high insulation property.

DESCRIPTION OF THE EMBODIMENTS

Figure 1:
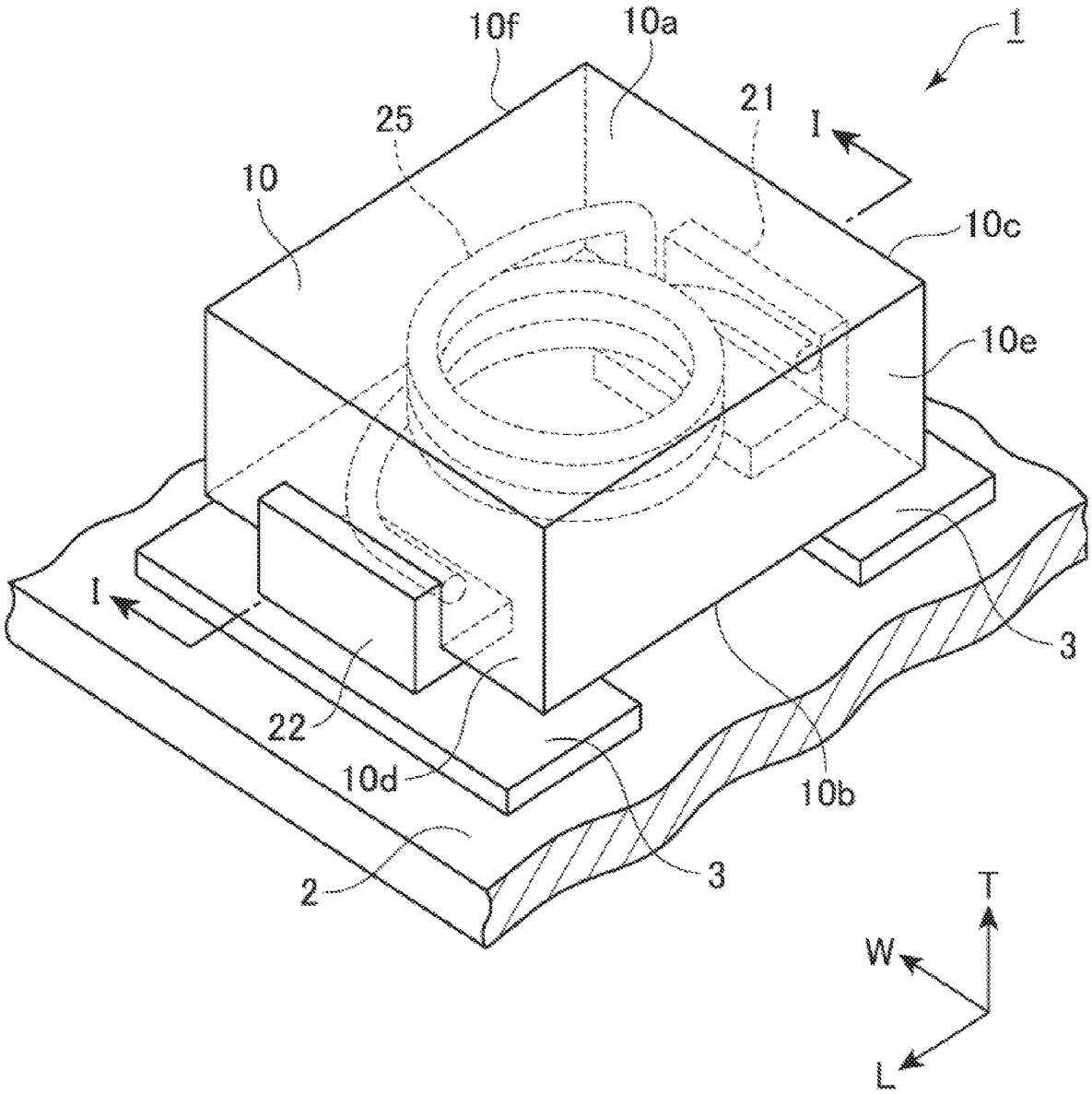
FIG. 1 is a perspective view of a coil element according to one embodiment of the invention.

A coil component 10 according to one embodiment of the invention will be hereinafter described with reference to FIGS. 1 to 3. FIG. 1 is a perspective view of an inductor according to one embodiment of the invention, FIG. 2 is a schematic sectional view of the inductor along the line I-I in FIG. 1, and FIG. 3 schematically illustrates a captured image of a region A of the section of FIG. 2.

In this specification, a "length" direction, a "width" direction, and a "thickness" direction of the inductor 1 are referred to as an "L" axis direction, a "W" axis direction, and a "T" axis direction in FIG. 1, respectively, unless otherwise construed from the context.

The illustrated inductor 1 is one example of the coil element to which the present invention is applicable. The invention may be applied to, for example, transformers, filters, reactors, and various any other coils and components in addition to inductors. The invention may be also applied to coupled inductors, choke coils, and any other magnetically coupled coils. As will be described later, since the magnetic base body 10 has a high magnetic permeability and a high insulation property, the inductor 1 is particularly suitable as an inductor used in a power supply. Applications of the inductor 1 are not limited to those explicitly described herein.

Figure 2:
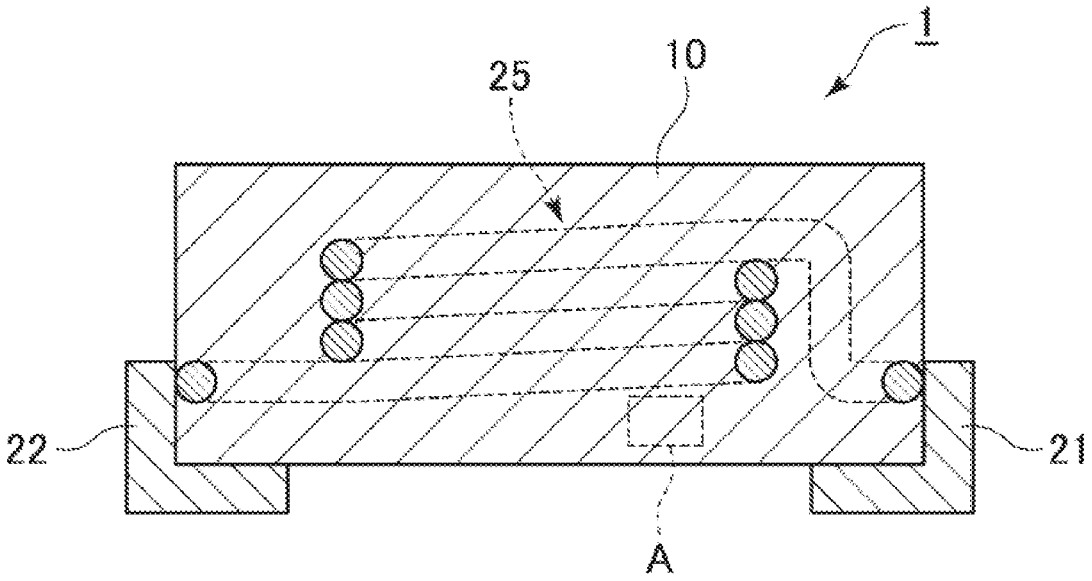
FIG. 2 is a view schematically showing a cross section of the coil element cut along the line I-I in FIG. 1.
Figure 3:
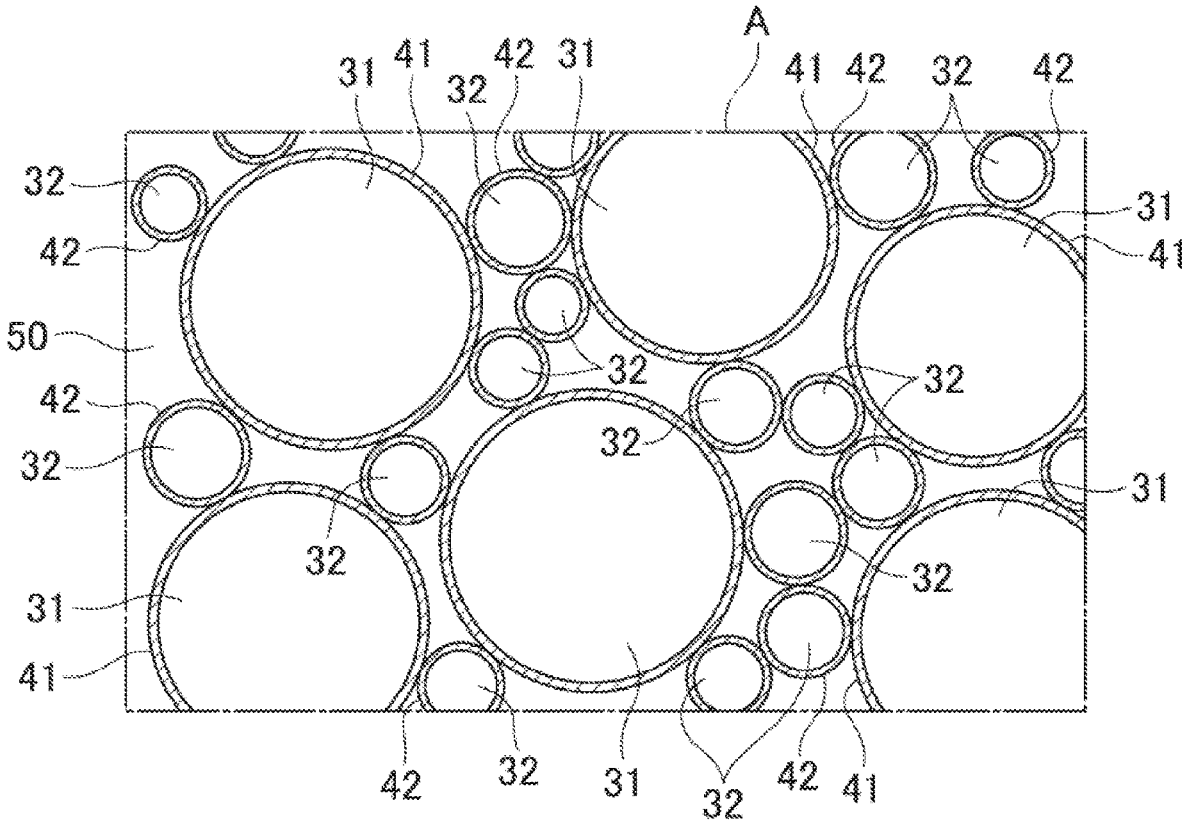
FIG. 3 schematically illustrates a captured image of a part of the cross section of FIG. 2.

As shown in FIGS. 1 to 3, the inductor 1 includes a magnetic base body 10, a coil conductor 25 embedded in the magnetic base body, an external electrode 21 electrically connected to one end of the coil conductor 25, and an external electrode 22 electrically connected to the other end of the coil conductor 25.

The magnetic base body 10 is formed of a magnetic material in a rectangular parallelepiped shape. In one embodiment of the invention, the magnetic base body 10 has a length (the dimension in the direction L) of 1.0 to 2.6 mm, a width (the dimension in the direction W) of 0.5 to 2.1 mm, and a thickness (the dimension in the direction T) of 0.5 to 1.0 mm. Alternatively, the dimension in the length direction may be 0.3 to 1.6 mm. The top surface and the bottom surface of the magnetic base body 10 may be covered with a cover layer.

The inductor 1 is mounted on a circuit board 2. A land portion 3 may be provided on the circuit board 2. In the case where the inductor 1 includes the two external electrodes 21 and 22, the circuit board 2 is provided with the two land portions 3 correspondingly. The inductor 1 may be mounted on the circuit board 2 by bonding each of the external electrodes 21, 22 to the corresponding land portions 3 on the circuit board 2. The circuit board 2 can be mounted in various electronic devices. Electronic devices with which the circuit board 2 is equipped may include smartphones, tablets, game consoles, and various other electronic devices. The inductor 1 may be suitably used in the circuit board 2 on which components are densely mounted. The inductor 1 may be a built-in component embedded in the circuit board 2.

The magnetic base body 10 has a first principal surface 10*a*, a second principal surface 10*b*, a first end surface 10*c*, a second end surface 10*d*, a first side surface 10*e*, and a second side surface 10*f*. The outer surface of the magnetic base body 10 may be defined by these six surfaces. The first principal surface 10*a* and the second principal surface 10*b* are opposed to each other, the first end surface 10*c* and the second end surface 10*d* are opposed to each other, and the first side surface 10*e* and the second side surface 10*f* are opposed to each other.

As shown in FIG. 1, the first principal surface 10*a* lies on the top side of the magnetic base body 10, and therefore, the first principal surface 10*a* may be herein referred to as "the top surface." Similarly, the second principal surface 10*b* may be referred to as "the bottom surface." The inductor 1 is disposed such that the second principal surface 10*b* faces the circuit board 2, and therefore, the second principal surface 10*b* may be herein referred to as "the mounting surface." The top-bottom direction of the inductor 1 refers to the top-bottom direction in FIG. 1.

The external electrode 21 is provided on the first end surface 10*c* of the magnetic base body 10. The external electrode 22 is provided on the second end surface 10*d* of the magnetic base body 10. As shown, these external electrodes may extend to the bottom surface of the magnetic base body 10. The shapes and arrangements of the external electrodes are not limited to the illustrated embodiment. For example, all of the external electrodes 21, 22 may be provided on the bottom surface 10*b* of the magnetic base body 10. In this case, the coil conductor 25 is connected to the external electrodes 21, 22 on the bottom surface 10*b* of the magnetic base body 10 through via conductors. The external electrode 21 and the second external electrode 22 may be separated from each other in the length direction.

In one embodiment of the invention, the magnetic base body 10 is formed by combining a plurality of soft magnetic metal particles having an oxide film on their surface. Adjacent soft magnetic metal particles are bonded to each other via each other's oxide film. Alternatively the adjacent soft magnetic metal particles may be directly bonded without the oxide film. There may be voids between the adjacent soft magnetic metal particles. Some or all of the voids may be filled with resin. In one embodiment, the resin contained in the magnetic base body 10 is, for example, a thermosetting resin having a high insulation property. Examples of a thermosetting resin used to form the magnetic base body 10 may include benzocyclobutene (BCB), an epoxy resin, a phenolic resin, an unsaturated polyester resin, a vinyl ester resin, a polyimide resin (PI), a polyphenylene ether (oxide) resin (PPO), a bismaleimide-triazine cyanate ester resin, a fumarate resin, a polybutadiene resin, and a polyvinyl benzyl ether resin.

The soft magnetic metal particles contained in the magnetic base body 10 may include two or more types of soft magnetic metal particles having different average particle sizes. In one embodiment, the magnetic base body 10 may contain two types of soft magnetic metal particles having different average particle sizes from each other. FIG. 3 is a schematic sectional view of the magnetic base body 10 including two types of soft magnetic metal particles that have different average particle sizes from each other. FIG. 3 schematically shows a photograph of a region A of the cross section of the magnetic base body taken by scanning electron microscope (SEM). The region A is an arbitrary region in the magnetic base body 10.

In the embodiment shown in FIG. 3, the magnetic base body 10 contains a plurality of first soft magnetic metal particles 31 and a plurality of second soft magnetic metal particles 32. In other embodiment, the magnetic base body 10 may contain three types of soft magnetic metal particles having different average particle sizes from each other. In one embodiment, the average particle size of the second soft magnetic metal particles 32 is 1/10 or less of the average particle size of the first magnetic metal particles 31. The average particle size of the second soft magnetic metal particles 32 is, for example, 0.1 μm to 20 μm. When the average particle size of the second soft magnetic metal particles 32 is one-tenth (1/10) or less of the average particle size of the first soft magnetic metal particles 31, the second soft magnetic metal particles 32 easily enter between the adjacent first metal magnetic particles 31. Consequently, the filling factor (density) of the soft magnetic metal particles in the magnetic base body 10 can be increased.

The average particle size of the soft magnetic metal particles contained in the magnetic base body 20 is determined based on a particle size distribution. To determine the particle size distribution, the magnetic base body is cut along the thickness direction (T direction) to expose a cross section, and the cross section is scanned by the scanning electron microscope (SEM) to take a photograph at a 1000 to 2000-fold magnification, and the particle size distribution is determined based on the photograph. For example, the value at 50 percent of the particle size distribution determined based on the SEM photograph can be set as the average particle size of the soft magnetic metal particles.

An insulating film 41 is provided on the surface of the first soft magnetic metal particles 31, and an insulating film 42 is provided on the surface of the second soft magnetic metal particles 32. The insulating film 41 and the insulating film 42 prevent short circuit between adjacent first soft magnetic metal particles 31, adjacent second soft magnetic metal particles 32, and the first soft magnetic metal particle 31 and the second soft magnetic metal particle 32. The insulating film 41 and the insulating film 42 are preferably formed to cover the whole surface of the soft magnetic metal particle. The insulating film 41 and the insulating film 42 are distinguished with the first soft magnetic metal particles 31 and the second soft magnetic metal particles 32 respectively on the basis of the difference in brightness in an SEM photograph taken by the scanning electron microscope (SEM) at about 10,000 fold magnification.

In the region A illustrated in FIG. 3, regions other than the first soft magnetic metal particles 31, the second soft magnetic metal particles 32, the insulating film 41, and the insulating film 42 is denoted by reference numeral 50. Resin or voids are present in the region indicated by reference numeral 50. Thus there is no iron in the region indicated by reference numeral 50.

The soft magnetic metal particles 31 and the soft magnetic metal particles 32 are formed of soft magnetic alloys containing iron. In one embodiment, the soft magnetic metal particles 31 and the soft magnetic metal particles 32 may be, for example, an Fe—Si alloy, an Fe—Si—Al alloy, or an Fe—Si—Cr alloy. The soft magnetic metal particles may include only particles of a single type alloy. The soft magnetic metal particles contained in a magnetic material for the magnetic base body 10 may include particles of two more types of alloy. For example, the first soft magnetic metal particle 31 may include particles of an Fe—Si alloy and particles of an Fe—Si—Al alloy. When the soft magnetic metal particles are formed of an alloy containing Fe, the content of Fe in the soft magnetic metal particles may be 90 wt % or more. In this way, it is possible to obtain the magnetic base body 10 having a fine magnetic saturation characteristics.

The insulating film 41 and the insulating film 42 provided on the surfaces of the soft magnetic metal particles 31 and the soft magnetic metal particles 32 respectively may be oxide films formed by, for example, oxidizing the surfaces of the soft magnetic metal particles 31 and the soft magnetic metal particles 32. In one embodiment, a coating film may be provided on the surfaces of the insulating film 41 and the insulating film 42. This coating film may be, for example, an amorphous silicon oxide film. The amorphous silicon oxide film may be formed on the surfaces of the soft magnetic metal particles 31 and the soft magnetic metal particles 32 by, for example, a coating process using a sol-gel method. The insulating film 41 and the insulating film 42 may be formed by oxidizing the surfaces of the soft magnetic metal particles 31 and the soft magnetic metal particles 32 before the coating film is formed or after the coating film is formed.

In one embodiment, thicknesses of the insulating film 41 and the insulating film 42 are 100 nm or less. The thicknesses of the insulating film 41 and the insulating film 42 can be changed depending on the average particle size of the corresponding soft magnetic metal particles.

In one embodiment, in a predetermined region of the section exposed by cutting the magnetic base body 10, the area occupied by the insulating film provided on the surfaces of the soft magnetic metal particles included in the magnetic base body 10 is 2% or more of the area occupied by the soft magnetic metal particles. Specifically, in the example shown in FIG. 3, the total area occupied by the insulating film 41 and the insulating film 42 is 2% or more of the total area occupied by the soft magnetic metal particles 31 and the soft magnetic metal particles 32. If a ratio of the area of the insulating film to the area of the soft magnetic metal particles is smaller than 2%, the insulating film becomes too thin and the insulation reliability becomes low.

The ratio of the area of the insulating film provided on the soft magnetic metal particles contained in the magnetic base body 10 to the area of the soft magnetic metal particles can be determined as follows. First, a cross section is exposed by cutting the magnetic base body 10 along, for example, the T direction. Next, energy dispersive X-ray analysis (EDS) is performed on an SEM photograph of a region of the cross section taken at a 5,000 to 10,000 fold magnification to obtain an iron distribution image. Based on the difference in brightness in the distribution image obtained in this way, the region shown in the SEM photograph are divided into the region A where the soft magnetic metal particles are present, a region B where the insulating film provided on the surfaces of the soft magnetic metal particles are present, and a region C other than these regions (region in which resin or voids exist). Since the region A has a significantly higher iron content compared to the region B, the region A and the region B are easily distinguished by a brightness difference in the distribution image. The area of the region A and the area of the region B are then calculated, and the ratio of the area of the region B to the area of the region A is calculated. The ratio of the area of the region B to the area of the region A calculated in this way corresponds to the ratio of the area of the insulating film provided on the soft magnetic metal particles to the area of the soft magnetic metal particles. In the above-described image processing, the iron distribution image obtained by EDS may be rendered in a gray scale, and binarization processing may be performed on the gray scale distribution image using a predetermined image brightness (for example, most common image brightness) as a threshold value. By this binarization process, it is possible to more clearly distinguish between the regions A and B that contain iron and the region C that does not contain iron.

The iron oxides contained in the insulating film 41 and the insulating film 42 include magnetite ($Fe_3O_4$) and hematite ($Fe_2O_3$). It has been known that the mechanical strength of the magnetic base body can be improved by adjusting the ratio of hematite to magnetite in the magnetic base body. For example, Japanese Patent Application Publication No. 2013-168648 proposes to increase the mechanical strength of the magnetic base body by setting the volume ratio of hematite to magnetite in the magnetic base body to 0.05 to 0.25. The inventors of the present application have discovered that by setting the ratio of hematite to magnetite in the magnetic base body containing the soft magnetic metal particles within an appropriate range, it is possible to make both the magnetic permeability and the insulation property of the magnetic base body to fall in a desirable range. Specifically, the ratio of magnetite to hematite in one embodiment of the invention is adjusted such that a peak intensity ratio (M/H) is in the range of 1 to 70 in a Raman spectrum obtained by measuring light scattered when the magnetic base body 10 is irradiated with an excitation laser with a wavelength of 488 nm. The peak intensity ratio (M/H) is a ratio of the peak intensity (peak intensity M) of the peak existing at around a wave number 712 $cm^{-1}$ to the peak intensity (peak intensity H) of the peak existing at around a wave number 1320 $cm^{-1}$. The peak existing at around the wave number 712 $cm^{-1}$ is assigned to the magnetite ($Fe_3O_4$), and the peak existing at around the wave number 1320 $cm^{-1}$ is assigned to hematite ($Fe_2O_3$). A peak assigned to magnetite ($Fe_3O_4$) appears in the range of wave number from 660 $cm^{-1}$ to 760 $cm^{-1}$ in the Raman spectrum. The "peak existing at around a wave number of 712 $cm^{-1}$" herein refers to a peak whose peak top appears in the range of a wave number of 660 $cm^{-1}$ to 760 $cm^{-1}$ in the Raman spectrum using an excitation laser with a wavelength of 488 nm. A peak assigned to hematite ($Fe_2O_3$) appears in the range of wave number from 1270 $cm^{-1}$ to 1370 $cm^{-1}$ in the Raman spectrum. The "peak existing at around a wave number of 1320 $cm^{-1}$" is a peak assigned to hematite ($Fe_2O_3$) and herein refers to a peak whose peak top appears in the range of a wave number of 1270 $cm^{-1}$ to 1370 $cm^{-1}$ in the Raman spectrum using the excitation laser with a wavelength of 488 nm. In the Raman spectrum obtained by measuring the light scattered when the magnetic base body 10 is irradiated with an excitation laser with a wavelength of 488 nm, the peak intensity ratio (M/H), that is a ratio of the peak intensity assigned to magnetite (peak intensity M) to the peak intensity assigned to hematite (peak intensity H) may be herein referred to as a "M/H peak ratio."

In another embodiment of the invention, the M/H peak ratio of the magnetic base body 10 is 1.5 to 5.8. In yet another embodiment of the invention, the M/H peak ratio of the magnetic base body 10 is 1.5 to 2.0.

The Raman spectrum of the magnetic base body 10 is obtained by irradiating a surface of the magnetic base body 10 with the excitation laser with a wavelength of 488 nm and measuring the light scattered by the magnetic base body 10 with a general spectroscopic measurement device. As the spectroscopic measurement device, for example, a Raman spectrophotometer (NRS-3300) manufactured by JASCO Corporation can be used.

The inventors studied the magnetic base body and found that the magnetic permeability is improved while the insulation property is deteriorated (a withstand voltage is lowered) when the content of magnetite in the magnetic base body is increased. The inventors also found that the magnetic permeability was lowered while the insulation property is improved (the withstand voltage is increased) when the content of hematite in the magnetic base body is increased. For an electronic component through which a large current flows, such as a power source inductor, it is desirable that the magnetic permeability is 25 or more and the withstand voltage is 1 V/μm or more.

A method of fabricating the inductor 1 will now be described. When the inductor 1 is fabricated by a compression process, the manufacturing method of the inductor 1 includes a molding step in which a composite magnetic material containing the soft magnetic metal particles is compacted to form a molded body, and a heat treatment step in which the molded body obtained by the molding step is heated.

In the molding step, the soft magnetic metal particles are first prepared and a slurry is made by mixing and kneading the soft magnetic metal particles and a binder. As the binder, may be used is a resin that has an excellent thermal decomposability and is easily removable. For example, a butyral resin or an acrylic resin may be used as such a binder. Next, a coil conductor is placed in a mold, the slurry is then poured into the mold in which the coil conductor is disposed, and a compacting pressure is applied thereto to obtain a molded body containing the coil conductor thereinside. The molding step may be performed by warm molding or may be performed by cold molding. When the warm molding is performed, the molding process is performed at a temperature that is lower than the thermal decomposition temperature of the binder and does not affect crystallization of the soft magnetic metal particles. For example, the warm molding is performed at a temperature of 150° C. to 400° C. The compacting pressure is, for example, 40 MPa to 120 MPa. The compacting pressure can be appropriately adjusted to obtain a desired filling rate.

After the molded body is obtained by the molding step, the fabrication method proceeds to the heat treatment step. In the heat treatment step, heat treatment is performed on the molded body obtained by the molding step. In the heat treatment step, the molded body obtained by the molding step is subjected to binder removal treatment at a temperature of 500° C. or lower, and further a heat treatment is performed at a temperature of 700° C. or higher for 1 to 120 minutes in a low oxygen atmosphere with an oxygen concentration of 5 to 3000 ppm. The binder removal treatment may be performed separately from the heat treatment. By appropriately selecting the amount of oxygen, the heating temperature, and the heating time, it is possible to obtain an oxide film having necessary characteristics. The low oxygen atmosphere used in the heat treatment step is, for example, in the range of 5 to 3000 ppm, 10 to 2900 ppm, 20 to 2800 ppm, 30 to 2700 ppm, 40 to 2600 ppm, 50 to 2500 ppm, 60 to 2400 ppm, 70 to 2300 ppm, 80 to 2200 ppm, 90 to 2100 ppm, or 100 to 2000 ppm. Since it may be difficult to keep the oxygen concentration below 50 ppm, the oxygen concentration may be higher than 50 ppm. The heating temperature in the heat treatment step is 600° C. or higher, 610° C. or higher, 620° C. or higher, 630° C. or higher, 640° C. or higher, 650° C. or higher, 660° C. or higher, 670° C. or higher, 680° C. or higher, 690° C. or higher, or 700° C. or higher. If the heating temperature is too high, bonding (necking) between soft magnetic metal particles occurs, which is undesirable. For this reason, the heating temperature is set 920° C. or lower, 900° C. or lower, 880° C. or lower, 860° C. or lower, 840° C. or lower, 820° C. or lower, or 800° C. or lower. The heating time is in the range of 20 minutes to 120 minutes.

By performing the heat treatment on the molded body under the above-described conditions, it is possible to obtain the magnetic base body having a peak intensity ratio (M/H) of 1 to 70, 1.5 to 5.8, or 1.5 to 2.0. The peak intensity ratio (M/H) is defined as the ratio of the peak intensity of the peak at around a wave number 712 $cm^{-1}$ assigned to magnetite to the peak intensity of the peak at around a wave number 1320 $cm^{-1}$ assigned to hematite is obtained.

Next, a conductor paste is applied to both end portions of the magnetic base body to form the external electrode 21 and the external electrode 22. The external electrode 21 and the external electrode 22 are provided such that they are electrically coupled to each end of the coil conductor provided in the magnetic base body. In the above-described manner, the inductor 1 is obtained.

The method of fabricating the inductor 1 is not limited to the above. For example, the inductor 1 may be alternatively fabricated by a lamination process. When the inductor 1 is fabricated by a lamination process, the soft magnetic metal particles and a binder are first kneaded to create a slurry, this slurry is poured into a mold, and a predetermined compacting pressure is then applied to form a magnetic material sheet. Subsequently, a conductive pattern is formed on the magnetic material sheet, and the magnetic material sheet on which the conductive pattern is formed is laminated to create a laminated body. The inductor 1 is completed by providing the external electrodes on the laminated body.

EXAMPLES

Examples of the invention will now be described. First, soft magnetic metal particles having a composition of Fe—Si—Cr (Fe: 95 wt %, Si: 3.5%, Cr: 1.5 wt %) were prepared. Subsequently, the particle group of the soft magnetic metal particles and polyvinyl butyral were mixed and kneaded to prepare a slurry. Next, the slurry was formed into a long sheet using a coating machine such as a die coater, and the sheet was cut into a plurality of rectangular parallelepiped magnetic sheets each having a thickness of 8 μm. Through holes for a via conductor were formed in the magnetic sheets at predetermined positions thereof. Subsequently, the through holes were filled with a conductive paste containing Ag, and the conductive paste was printed in predetermined patterns on surfaces of a magnetic sheet and another magnetic sheet. The magnetic sheets on which the conductive patterns are formed in this way are laminated so that the conductive patterns formed on the different magnetic sheets are electrically connected via the conductors embedded in the through holes. These magnetic sheets are temporary bonded at 60° C. to obtain a laminated body. Sixteen laminated bodies were made in the above described manner.

Next, a heat treatment was performed on the sixteen laminated bodies thus obtained. The heat treatment was performed using atmospheres having different oxygen concentrations for each laminated body at different heating temperatures for different heating times. Three of the sixteen laminates were heat-treated under the atmospheric air, and two were heat-treated in an extremely low oxygen concentration atmosphere having an oxygen concentration of 3 ppm or less.

Two external electrodes were provided to each of the sixteen laminated bodies that had been subjected to the heat treatment. One of the two external electrodes was connected to one end of the conductive pattern, and the other external electrode was connected to the other end of the conductive pattern and sixteen inductors were obtained. Sample numbers from 1 to 16 are assigned to these sixteen inductors. Samples Nos. 1 to 3 correspond to samples that had been heat-treated in the atmospheric air. Samples Nos. 15 and 16 correspond to samples that had been heat-treated in the extremely low oxygen concentration atmosphere.

With respect to each of the sixteen inductors with sample Nos. 1 to 16 obtained as described above, the Raman spectrum was measured using a Raman spectrophotometer (NRS-3300) manufactured by JASCO Corporation. Specifically, a surface of each sample from No. 1 to No. 16 were irradiated with an excitation laser with a wavelength of 488 nm and light scattered by the inductor were observed using NRS-3300 to obtain sixteen Raman spectra. For the sixteen Raman spectra thus obtained, calculated were the peak intensity ratio (M/H), which is a ratio of the peak intensity (peak intensity M) of the peak exiting at around a wave number of 712 $cm^{-1}$ to the peak intensity (peak intensity H) of the peak existing at around a wave number of 1320 $cm^{-1}$.

Further, the magnetic permeability of each of the inductors of samples Nos. 1 to 16 was measured using a BH analyzer.

For each of the inductors of sample Nos. 1 to 16, the voltage when a short circuit occurs was measured by increasing the voltage applied between the external electrodes in a stepwise manner. A value obtained by dividing the voltage at the time of the short-circuit by the distance between the conductive patterns was defined as the withstand voltage of each sample.

Table 1 summarizes the peak intensity ratio, the magnetic permeability, and the withstand voltage for each of the samples Nos. 1 to 16 obtained as described above.

TABLE 1

| Sample No. | Peak Intensity Ratio (M/H) | Permeability | Withstand voltage [V/μm] | Quality |
|---|---|---|---|---|
| 1 (Comparative Ex.) | 0.33 | 18 | 2 | Defective |
| 2 (Comparative Ex.) | 0.6 | 20 | 1.9 | Defective |
| 3 (Comparative Ex.) | 0.93 | 23 | 1.8 | Defective |
| 4 (Example) | 1.1 | 26 | 1.8 | Good |
| 5 (Example) | 1.29 | 28 | 1.7 | Good |
| 6 (Example) | 1.47 | 30 | 1.6 | Good |
| 7 (Example) | 1.82 | 32 | 1.6 | Good |
| 8 (Example) | 2.01 | 32 | 1.5 | Good |
| 9 (Example) | 4.2 | 32 | 1.4 | Good |
| 10 (Example) | 5.82 | 32 | 1.4 | Good |
| 11 (Example) | 12.2 | 32 | 1.3 | Good |
| 12 (Example) | 25.8 | 32 | 1.2 | Good |
| 13 (Example) | 52.9 | 33 | 1.1 | Good |
| 14 (Example) | 70.8 | 33 | 1 | Good |
| 15(Comparative Ex.) | 73 | 34 | 0.8 | Defective |
| 16(Comparative Ex.) | 81.6 | 34 | 0.05 | Defective |

For an electronic component through which a large current flows, such as a power source inductor, it is desirable that the magnetic permeability is 25 or more and the withstand voltage is 1 V/μm or more. In Table 1, a sample having a magnetic permeability of 25 or more and a withstand voltage of 1 V/μm or more was determined as a good product. For samples determined to be good, "Good" is shown in the "Quality" column of Table 1. A sample having a magnetic permeability of less than 25 or a withstand voltage of less than 1 V/μm was determined as a defective product. For samples determined to be defective, "Defective" is shown in the "Quality" column of Table 1.

From the measurement results shown in Table 1, it was found that when the M/H peak ratio falls in the range of 1 to 70, the magnetic permeability becomes 25 or more and the withstand voltage becomes 1 V/μm or more. It can be seen from Table 1 that the magnetic permeability is 25 or more and the withstand voltage is 1 V/μm or more. Whereas when the M/H peak ratio is 70.8 or more, the withstand voltage is less than 1 V/μm, and when the M/H peak ratio is 0.93 or less, the magnetic permeability is 23 or less. Thus, when the M/H peak ratio of the magnetic base body is in the range of 1 to 70, it is possible to achieve a high permeability and a high insulation property desirable for an inductor used in power source related components.

It can be seen from Table 1 that when the M/H peak ratio is in the range of 1.5 to 5.8, the magnetic permeability is 30 or more and the withstand voltage is 1.4 V/μm or more. Thus, a magnetic base body having an M/H peak ratio in the range of 1.5 to 5.8 has more excellent characteristics as an inductor.

It can be seen from Table 1 that when the M/H peak ratio is in the range of 1.5 to 2.0, the magnetic permeability is 30 or more and the withstand voltage is 1.5 V/μm or more. Thus, a magnetic base body having an M/H peak ratio in the range of 1.5 to 2. 0 has more excellent characteristics as an inductor.

When the M/H peak ratio is less than 1, the magnetic permeability is less than 25, and desired magnetic characteristics cannot be obtained. This is presumably because the filling rate has decreased due to the increase of the amount of the insulating oxide film on the surface of the soft magnetic metal particles during the heat treatment in the atmospheric air. When the heat treatment is performed in the atmospheric air, which is commonly performed in the field, the M/H peak ratio becomes less than 1.

As can be seen from the measurement results of Sample No. 15 and Sample No. 16, if the M/H peak ratio exceeds 73, the withstand voltage is less than 1 V/μm, and desired insulation characteristics cannot be obtained. This is presumably because when the heat treatment is performed under an extremely low oxygen atmosphere with an oxygen concentration of 3 ppm or less (or an oxygen-free atmosphere), oxygen is not supplied to the surfaces of the soft magnetic particles so that the generation of the insulating oxide film is not promoted. Whereas when the heat treatment is performed under an atmosphere having a certain level of oxygen content, an oxide is newly formed on the surfaces of the soft magnetic metal particles during the heat treatment.

Each of the inductors of Samples Nos. 1 to 16 was cut along its thickness direction (T direction) to expose the cross section, and the cross section is photographed taken at 10,000 fold magnification with a scanning electron microscope (SEM). The SEM photograph was then subjected to energy dispersive X-ray analysis (EDS) to obtain an iron element distribution image. Based on the difference in brightness in the distribution image thus obtained, the region A where the soft magnetic metal particles are present, the region B where the insulating film provided on the surface of the soft magnetic metal particles is present, and the region C other than these regions (region in which resin or voids exist) were distinguished. Subsequently the area of the region A and the area of the region B were calculated, and the ratio of the area of the region B to the area of the region A was calculated in percentage. The calculation result showed that the ratio of the area of the region B to the area of the region A was in the range of 2.3% to 7.4% for the samples Nos. 1 to 14, 1.8% for the sample No. 15, and 1.4% for the sample No. 16.

The dimensions, materials, and arrangements of the various constituent elements described herein are not limited to those explicitly described in the embodiments, and the various constituent elements can be modified to have any dimensions, materials, and arrangements within the scope of the present invention. Furthermore, constituent elements not explicitly described herein can also be added to the embodiments described, and it is also possible to omit some of the constituent elements described in the embodiments.

What is claimed is:

1. A magnetic base body, comprising:

a plurality of soft magnetic metal particles made of an iron-containing alloy, the plurality of soft magnetic metal particles including a first soft magnetic metal particle and a second soft magnetic metal particle adjacent to the first soft magnetic metal particle;

a first oxide film formed on a surface of the first soft magnetic metal particle by oxidization of elements contained in the first soft magnetic metal particle; and a second oxide film formed on a surface of the second soft magnetic metal particle by oxidization of elements contained in the second soft magnetic metal particle, wherein the first oxide film is in direct contact with the second oxide film to bond the first soft magnetic metal particle to the second soft magnetic metal particle, and wherein, in a Raman spectrum obtained by using an excitation laser with a wavelength of 488 nm, a peak intensity ratio is 1 to 70, the peak intensity ratio being defined as a ratio of a peak intensity of a first peak existing at around a wave number of 712 $cm^{-1}$ to a peak intensity of a peak existing at around a wave number of 1320 $cm^{-1}$.

2. The magnetic base body of claim 1, wherein the peak intensity ratio is 1.5 to 5.8.

3. The magnetic base body of claim 2, wherein the peak intensity ratio is 1.5 to 2.0.

4. The magnetic base body of claim 1, wherein, in a cross-sectional photograph of the magnetic base body taken with a scanning electron microscope, a ratio of an area of the first and second oxide films to an area of the first and second soft magnetic metal particles is 2% or more.

5. An electronic component comprising the magnetic base body of claim 1.

6. An electronic component, comprising:

the magnetic base body of claim 1; and a coil provided in the magnetic base body.

7. The magnetic base body of claim 1, wherein the plurality of soft magnetic metal particles has a composition of Fe—Si—Cr.

8. The magnetic base body of claim 7, wherein a ratio of the composition of Fe—Si—Cr is 95 wt % Fe, 3.5 wt % Si, and 1.5 wt % Cr.

9. A magnetic base body, comprising:

soft magnetic metal particles having an insulating film on their surfaces, wherein, in a Raman spectrum obtained by using an excitation laser with a wavelength of 488 nm, a peak intensity ratio is 1 to 70, the peak intensity ratio being defined as a ratio of a peak intensity of a first peak existing at around a wave number of 712 cm−1 to a peak intensity of a peak existing at around a wave number of 1320 cm−1, and wherein the peak intensity ratio is 1.5 to 2.0.

10. The magnetic base body of claim 9, wherein, in a cross-sectional photograph of the magnetic base body taken with a scanning electron microscope, a ratio of an area of the insulating film to an area of the soft magnetic metal particles is 2% or more.

11. The magnetic base body of claim 9, wherein the soft magnetic metal particles are made of an iron-containing alloy.

12. The magnetic base body of claim 9, wherein the plurality of soft magnetic metal particles has a composition of Fe—Si—Cr.

13. The magnetic base body of claim 12, wherein a ratio of the composition of Fe—Si—Cr is 95 wt % Fe, 3.5 wt % Si, and 1.5 wt % Cr.

14. An electronic component comprising the magnetic base body of claim 9.

15. An electronic component, comprising:

the magnetic base body of claim 9; and a coil provided in the magnetic base body.

* * * * *